US006659598B2

(12) United States Patent
Grimes et al.

(10) Patent No.: US 6,659,598 B2
(45) Date of Patent: Dec. 9, 2003

(54) APPARATUS AND METHOD FOR DISPERSING NANO-ELEMENTS TO ASSEMBLE A DEVICE

(75) Inventors: Craig A. Grimes, Lexington, KY (US); Elizabeth Dickey, Lexington, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 440 days.

(21) Appl. No.: 09/828,606

(22) Filed: Apr. 7, 2001

(65) Prior Publication Data

US 2002/0005876 A1 Jan. 17, 2002

Related U.S. Application Data

(60) Provisional application No. 60/195,875, filed on Apr. 7, 2000.

(51) Int. Cl.[7] ..... B41J 2/035; B41J 2/10

(52) U.S. Cl. ..... 347/77; 347/925

(58) Field of Search ..... 347/53, 73, 76, 347/77, 923, 925

(56) References Cited

U.S. PATENT DOCUMENTS

| | | | | |
|---|---|---|---|---|
| 3,877,036 A | * | 4/1975 | Loeffler et al. | 347/77 |
| 4,027,309 A | * | 5/1977 | Manning et al. | 347/53 |
| 4,068,240 A | * | 1/1978 | Fan et al. | 347/53 |
| 4,086,602 A | * | 4/1978 | Yamada | 347/77 |
| 4,162,502 A | | 7/1979 | Cielo et al. | 347/55 |
| 4,166,277 A | | 8/1979 | Cielo et al. | 347/55 |
| 4,275,290 A | | 6/1981 | Cielo et al. | 219/216 |
| 4,463,363 A | | 7/1984 | Gundlach et al. | 346/158 |
| 4,524,371 A | | 6/1985 | Sheridon et al. | 346/159 |
| 5,257,045 A | | 10/1993 | Bergen et al. | 346/159 |
| 5,547,748 A | | 8/1996 | Ruoff et al. | 428/323 |
| 5,547,774 A | | 8/1996 | Gimzewski et al. | 428/694 ML |
| 5,626,812 A | | 5/1997 | Ebbesen et al. | 264/248 |
| 5,745,128 A | | 4/1998 | Lam et al. | 346/140.1 |
| 5,916,642 A | | 6/1999 | Chang | 427/580 |
| 5,925,465 A | | 7/1999 | Ebbesen et al. | 428/408 |
| 5,933,791 A | | 8/1999 | Hamada et al. | 702/30 |

FOREIGN PATENT DOCUMENTS

| | | |
|---|---|---|
| WO | WO 98/0592 | 2/1998 |
| WO | WO 98/42620 | 10/1998 |

OTHER PUBLICATIONS

Cees Dekker, "Carbon Nanotubes as Molecular Quantum Wires," *Physics Today*, pp. 22–28 (May 1999).

R.F. Service, "Superstrong Nanotubes Show They Are Smart, Too," *Science*, 281, 940–942 (Aug. 14, 1998).

Ray H. Baughman, et al., "Carbon Nanotube Actuators," *Science*, 284, 1340–1344 (May 21, 1999).

(List continued on next page.)

*Primary Examiner*—Anh T.N. Vo
(74) *Attorney, Agent, or Firm*—Macheledt Bales LLP

(57) ABSTRACT

An apparatus for dispersing a first plurality of conductive elongated nano-elements distributed within a carrier-fluid to assemble a conductive device made of a first charge-receptive area of a support surface to which at least one nano-element has attached, including: a nozzle through which the elongated nano-elements are directed such that the nano-elements pass through an electromagnetic field for imparting a preselected charge thereto, and toward at least the first charge-receptive area. The charge-receptive area is given a charge such that it attracts a first end-portion of one of the nano-elements. Also, a method of assembling a conductive device. Steps include: applying a first charge to the first charge-receptive area to attract a first end-portion of at least one nano-element; and dispersing from a nozzle, the plurality of elongated nano-elements distributed within a carrier-fluid initially contained in a reservoir, such that the nano-elements pass through an electromagnetic field for imparting a preselected charge thereto and toward the first charge-receptive area.

22 Claims, 4 Drawing Sheets

OTHER PUBLICATIONS

Walt A. de Heer, et al., "Aligned Carbon Nanotube Films: Production and Optical and Electronic Properties," *Science*, 268, 845–847 (May 12, 1995).

A. Yu Kasumov, et al., "Supercurrents Through Single–Walled Carbon Nanotube," *Science*, 284, 1508–1511 (May 28, 1999).

E. W. Wong, P.E. Sheehan and C.M. Lieber, "Nanobeam Mechanics: Elasticity, Strength and Toughness of Nanorods and Nanotubes", *Science*, 277, 1971–1975 (1997).

H. Dai, E. W. Wong, Y.Z. Lu, S. Fan, and C.M. Lieber, "Synthesis and Characterization of Carbide Nanorods," *Nature*, 375, 769 (1995).

E. W. Wong, B. W. Maynor, L.D. Burns and C.M. Lieber, "Growth of Metal Carbide Nanotubes and Nanorods", *Chem. Mater*. 8, 2041–2046 (1996).

Mona B. Mohamed, Kamal Z. Ismail, Stephan Link, and Mostafa A. El–Sayed, "Thermal Reshaping of Gold Nanorods in Micelles", *JPhysChemB*, 102 (47), 9370–9374 (1998).

B. R. Martin, D. J. Dermody, B. D. Reiss, M. Fang, L. A. Lyon, M. J. Natan, and T. E. Mallouk, "Orthogonal Self Assembly on Colloidal Gold–Platinum Nanorods," *Adv. Mater*., 11, 1021–1025 (1999).

S. Link, M. B. Mohamed, and M. A. El–Sayed, "Simulation of the Optical Absorption Spectra of Gold Nanorods as a Function of Their Aspect Ratio and the Effect of the Medium Dielectric Constant", *JPhysChemB*, 103 (16), 3073–3077 (1999).

W. L. Buehner, J. D. Hill, T.H. Williams, J. W. Woods, "Application of Ink Jet Technology to a Word Processing Output Printer", IBM J. Res. Develop, pp. 2–9, (Jan. 1977).

Figure 1 entitled "Continuos Ink Jet Technology".

Figure 2 entitled "Thermal Drop on Demand Method".

Figure 3A–B entitled "Drop on Demand Printheads" & "DeskJet Printer".

* cited by examiner

APPARATUS AND METHOD FOR DISPERSING NANO-ELEMENTS TO ASSEMBLE A DEVICE

This application claims the benefit of Provisional Application No. 60/195,875, filed Apr. 7, 2000.

BACKGROUND OF THE INVENTION

In general, the present invention relates to the fabrication of tiny conductive devices sized on the order of the microcircuits, and even smaller, that operate as active elements on printed circuit boards, or any other such support structure, of varying sizes (including microchip-sized to the level of so-called molecular electronics where one or a small collection of molecules is capable of operating as an active electronic element). The fabrication of extremely small reliable components and complex circuits, although difficult, is very important to the ongoing development and distribution of miniaturized computerized contraptions ranging from analytical instruments and testing equipment (whether simple or complex) such as sensors, voltmeters, data collection equipment, and so on, to consumer devices such as notebook computers, multifunctional palm-sized computers, watch-sized computerized cellular communication devices, etc.

More particularly, the invention relates to a new apparatus that incorporates a unique method for dispersing a plurality of elongated nano-sized elements within a carrier-fluid to assemble any of a number of different tiny conductive devices built to replace a wide variety of conventional devices or built to the specifications of new conductive devices; such devices to include: diodes (used as light emitters and sensors, switches, etc.), transistors, on-tube junctions, capacitors, inductors, resistors, oscillators, MEMS (MicroElectroMechanical System) technology elements/devices—tiny mirrors, sensors, light reflectors, switches, microactuators, read/write heads, etc.

The apparatus includes a nozzle or orifice through which the elongated nano-elements within the carrier-fluid are directed such that they pass through an electromagnetic (EM) field and toward a first charge-receptive area of a support surface. This charge-receptive area has been given a charge to attract at least an end-portion of one of the nano-elements. The amount of charge held by the charge-receptive area being targeted depends upon the charge imparted to one or both ends of the nano-element upon passing through the EM field. A second charge-receptive area having a charge to attract either a second end-portion of the first nano-element or an end-portion of a second nano-element is preferably included; this second area in proximity to the first charge-receptive area, multiple charge-receptive areas may be patterned as needed.

If the carrier-fluid is in liquid form, the liquid is chosen so that preferably a substantial amount of it evaporates once the nano-element has attached to the charge-receptive area being targeted. If the carrier-fluid is in gas form, to minimize unwanted turbulence of the gas being discharged from the nozzle in an effort to better control flow and direction of nano-elements toward, as well as attachment thereof to a respective the charge-receptive area, preferably the area around the nozzle and charge-receptive area being targeted is under vacuum (i.e., the pressure around the charge-receptive area being targeted is less than the surrounding area) or the nano-elements within carrier-fluid are dispersed and directed toward target charge-receptive areas under high pressure.

I. Technical Background/History of Nanotubes

Carbon nanotubes belong to a small family of carbon compounds known as fullerenes. These tube-like structures may have single walls or multiple walls, generally each nanotube wall is essentially one carbon atom thick. They have been described as tiny strips of graphite sheet rolled into tubes and capped with half a fullerene at each end. Nanotubes may be multiwalled (made up of several concentric hollow cylinders of carbon atoms nested inside each other) or single-walled with an outer diameter on the order of 1 nanometer (a billionth of a meter) and length varies from several microns to $100^{+}$ microns depending upon, among other things, fabrication method used to form the nanotubes. Nanotubes are very strong, stable (chemically inert), lightweight, and can withstand repeated bending, buckling, and twisting-plus they are efficient heat transfer agents. Atoms in a nanotube arrange themselves in hexagonal rings like chicken wire.

Graphite is a semimetal: Whereas most other electrical conductors can be classified as either a metal or a semiconductor, graphite is balanced in the transitional zone between the two. This is due to the unique properties of the building material of graphite, namely, carbon. Under intense pressure, carbon atoms form bonds with four neighboring carbons, creating the pyramidal arrangement of diamond. When carbon forgoes that fourth bond and links up with only three neighbors, it creates the hexagonal rings in graphite's structure. This arrangement leaves graphite with a host of unpaired electrons, which effectively 'float' above or below the plane of carbon rings. These floating electrons are more or less free to buzz around graphite's surface, which makes it a good electrical conductor. It is, however, these unattached bonds that leaves carbon atoms at the border of a graphite sheet susceptible to reaction with something nearby. This characteristic is what allows a heated (1200 degrees Celsius, or so) graphite sheet to curl back against itself, inter-knit together, and form a tiny cylindrical graphite element now commonly referred to as a nanotube.

In a graphite sheet, one particular electron state (called the Fermi Point) gives graphite almost all of its conductivity; none of the electrons in other states are free to move about. Statistically, only a fraction (estimated at one-third) of graphite walled nanotubes of any collection will act as truly metallic nanowires, while the remaining two-thirds will operate like semiconductors. Meaning that these nanotubes do not conduct current easily without an additional boost of energy (by way of a burst of light or sufficient voltage) to knock electrons from valence states into conducting states along the nanotube. The amount of energy needed depends on the separation between the two levels and is the so-called band gap of a semiconductor. It is this band gap that makes semiconductors useful in circuits. Carbon nanotubes do not all have the same band gap, because for every circumference there is a unique set of allowed valences and conduction states. The smaller-diameter nanotubes have very few states that are spaced far apart in energy. As the diameter increases, more and more states are allowed and the spacing between them shrinks. In this way, different-sized nanotubes can have band gaps as low as zero (similar to a metal), or as high as the band gap of silicon, and almost anywhere in between-making it readily tuned. It is predicted that multiwalled nanotubes have even more complex behavior, as each layer in the tube has its own, individual geometry.

In connection with describing a computer-designed model of nanotube gears that have benzene groups arrayed around the nanotube to act as cogs whereby, as a nanocylinder rolls, its tiny teeth turn the nanotube like a microscopic drive shaft, SCIENCE magazine author Robert F. Service admits that fabrication remains an issue ("Superstrong Nanotubes Show They Are Smart, Too", Aug. 14, 1998, Vol. 281, see pg. 942): "[n]anogears are likely to remain simulations for some time, however, as there's no obvious way to build them." As reported in the December 2000 issue of Scientific American ("Nanotubes for Electronics", Philip Collins and Phaedon Avouris, see pg. 66) the authors explain their labor-intensive method of forming a FET: "We should emphasize, however, that so far our circuits have all been made one at a time and with great effort. The exact recipe for attaching a nanotube to metal electrodes varies among different research groups, but it requires combining traditional lithography for the electrodes and higher-resolution tools such as atomic force microscopes to locate and even position the nanotubes." Thus, current fabrication methods fall short of being feasible in large-scale nano-size device production. As further reported by Collins and Avouris, when oriented on-end and electrified, carbon nanotubes will act like a lightning rod, concentrating the electrical field at its tip. Because the ends are so 'sharp', such charged nanotubes efficiently emit electrons at lower voltages (a behavior called "field emission") than electrodes made from most other materials. The fabrication and properties of nanotubes as well as speculation on potential uses and applications, have been the subject of numerous publications.

Though the apparatus and method of assembling a conductive device of the invention provides a means by which batch processing of nano-sized devices and elements may be more cost-effectively achieved utilizing the relatively recently identified elongated structures referred to as nanotubes, other elongated conductive elements (whether filled-in in a nanorod shape or hollow as are nanotubes) with similar aspect ratios having sufficient structural integrity to withstand dispersion within a suitably selected carrier-fluid through a nozzle, have been developed and are referred to in more detail in the following technical papers, each of which is incorporated herein by reference to the extent details of elongated structures for use according to the invention, are set forth:

(A) E. W. Wong, P. E. Sheehan and C. M. Lieber, "Nanobeam Mechanics: Elasticity, Strength and Toughness of Nanorods and Nanotubes", *Science, 277,* 1971–1975 (1997);

(B) H. Dai, E. W. Wong, Y. Z. Lu, S. Fan, and C. M. Lieber, "Synthesis and Characterization of Carbide Nanorods," *Nature,* 375, 769 (1966);

(C) E. W. Wong, B. W. Maynor, L. D. Burns and C. M. Lieber, "Growth of Metal Carbide Nanotubes and Nanorods", *Chem. Mater.* 8, 2041–2046 (1996);

(D) Mona B. Mohamed, Kamal Z. Ismail, Stephan Link, and Mostafa A. El-Sayed, "Thermal Reshaping of Gold Nanorods in Micelles", *JPhysChemB,* 102 (47), 9370–9374 (1998);

(E) B. R. Martin, D. J. Dermody, B. D. Reiss, M. Fang, L. A. Lyon, M. J. Natan, and T. E. Mallouk, "Orthogonal Self Assembly on Colloidal Gold-Platinum Nanorods," *Adv. Mater.,* 11, 1021–1025 (1999); and (F) S. Link, M. B. Mohamed, and M. A. El-Sayed, "Simulation of the Optical Absorption Spectra of Gold Nanorods as a Function of Their Aspect Ratio and the Effect of the Medium Dielectric Constant", *JPhysChemB,* 103 (16), 3073–3077 (1999).

II. Conventional way to make Microelements/ Microcircuits

Microelectronics is that area of electronics technology associated with the fabrication of electronic systems or subsystems using extremely small (microcircuit) components. The conventional method by which microelements and microprocessors are fabricated is by way of a series of layering steps are performed. Microcircuit wafer fabrication generally starts with a substrate to which layers, films, and coatings (such as photoresist) can be added or created (e.g., when fabricating a MOS monolithic IC, a silicon oxide layer is created on top of the silicon wafer), and from which these added or created materials can be subtractively etched (e.g., as in dry etching). Additionally, throughout semiconductor wafer fab, various processes are used to clean wafers so that surfaces are reproducible and stable (see for general reference, "Microelectronics: Processing and Device Design" by Prof. Roy A. Colclaser, John Wiley & Sons (1980), pg. 82). The substrate for a microelectronic circuit is the base upon which the circuit is fabricated. The use of silicon and its oxide, along with photolithography, in semiconductor wafer fabrication dates back to the 1950's. A substrate must have sufficient mechanical strength to support its circuit(s) during fabrication, and substrate electrical characteristics depend on the type of microcircuit being fabricated.

SUMMARY OF THE INVENTION

It is a primary object of this invention to provide an apparatus for dispersing a plurality of conductive elongated nano-elements distributed within a carrier-fluid (whether in liquid or gas state) toward at least one charge-receptive area of a support surface to assemble a conductive device therewith. It is a further object to provide a conductive device for use and operation as an electrically-driven device or as a component of an electrical device, comprising a first charge-receptive area of a support surface to which at least an end-portion of one of a plurality of elongated nano-elements has attached. The charge-receptive area has, at least initially upon dispersion of the carrier-fluid with nano-elements, a charge that attracts the nano-element end-portion that ultimately attaches. It is also an object of this invention to provide a method of assembling such a conductive device having a first charge-receptive area of a support surface to which at least one of a plurality of elongated nano-elements has attached. The method comprises the steps of: charging the first charge-receptive area to attract at least one of the nano-elements in the plurality; dispersing from a nozzle, the plurality of elongated nano-elements distributed within a carrier-fluid such that the nano-elements pass through an electromagnetic (EM) field and toward at least the first charge-receptive area.

The innovative apparatus, method, and conductive devices produced therewith, as contemplated and described herein, has been designed to accommodate a variety of alternatives, including but not limited to the following list of features: dispersing nano-elements within a carrier-fluid that is in a liquid or gas state, with the apparatus configured accordingly to have a micro-sized nozzle suitable for directing the carrier-fluid containing the nano-elements out of an associated carrier-fluid reservoir, suitable techniques/ technologies for charging or creating the charge-receptive area(s) or patterns such that respective nano-elements are attracted thereto, including direct application of ions to the substrate surface in a manner similar to any of those used to create the charged or electrostatic latent image used in ionography printing, or utilizing techniques applied in the formation of an electrostatic latent image as is done in xerography printing, and so on; many different types of substrate supports made of a wide variety of materials are contemplated; many different shapes of conductive nano-elements including nanorods and the class of graphite elongated hollow elements commonly referred to as nanotubes; many different configurations/patterns of charge-receptive areas on the various support surfaces are contemplated as are a wide variety of conductive device structures made according to the invention, whether single- or multiwalled/layered structures built atop one or more charge-receptive areas of the substrate surface and/or projections or protrusions therefrom.

Furthermore, in the spirit of design goals contemplated by this disclosure, whether expressed: (a) The simple, innovative apparatus and method may be carried out by employing, or readily tailored to use, currently-available subassemblies and computer processors, as well as associated storage and memory, etc., to control the quality and quantity of assembling conductive devices of the invention in small batches or in large numbers in a fully- or partially-automated assembly-line fashion; and (b) In connection with efforts to miniaturize electrical equipment and systems, conductive device structures produced according to the invention may function as replacements, or subcomponents, for known electrical elements such as capacitors, inductors, transistors, diodes, logic gates, circuits, actuators, sensing elements, pumps, and so on.

The development efforts within the electronics industry continues to head in the direction of developing extremely tiny, yet reliable, electronic components. However, conventional means to do so will soon, or has, hit the point at which even a very small reduction in size can only be achieved at great cost. Unlike the conventional limited component/device fab systems currently in use, the apparatus and associated method of the invention, as well as the conductive devices produced thereby, utilize an innovative approach. None of the currently-available microcomponent/microcircuit fabrication systems disperse a carrier-fluid with nano-elements directed at a target charge-receptive area(s) that carries a charge to attract elongated conductive element (s), for example carbon nanotubes or nanorods, according to a final desired useful device structure.

Certain advantages of providing the flexible new apparatus, conductive devices, and associated new method, as described herein, include without limitation:

(a) Nano-sized device fabrication cost reduction.

(b) Device, apparatus, and process design flexibility and versatility.

(c) Process simplification.

(d) Device design flexibility.

Briefly described, once again, the invention includes an apparatus for dispersing a first plurality of conductive elongated nano-elements distributed within a carrier-fluid to assemble a conductive device. The apparatus includes: a nozzle through which the elongated nano-elements are directed such that the nano-elements pass through an electromagnetic field for imparting a preselected charge thereto, and toward at least a first charge-receptive area of a support surface. The charge-receptive area has a charge such that it attracts a first end-portion of one of the nano-elements. The assembled conductive device comprises the first charge-receptive area to which at least the nano-element has attached. The nano-elements include those nano-sized structures having an aspect ratio on the order of 100 to 10,000, whether hollow, capsule-like, or filled-in. The carrier-fluid may be in liquid form (nano-elements dispersed within at least one droplet), preferably substantially evaporating once the nano-element has attached; or in gas form, preferably dispersed as a high pressure fluid or the nozzle and charge-receptive area being under vacuum (decrease defects due to turbulent flow).

Also characterized is a method of assembling a conductive device. Steps include: applying a first charge to the first charge-receptive area to attract a first end-portion of the one nano-element; and dispersing from a nozzle, the plurality of elongated nano-elements distributed within a carrier-fluid initially contained in a reservoir, such that the nano-elements pass through an electromagnetic field for imparting a preselected charge thereto and toward the first charge-receptive area. The step of applying a respective charge to a charge-receptive area can include: applying a first voltage potential to the area such that the charge is retained at least until the target nano-element so attaches; or suitably depositing charged ions to each respective area; and so on. A second plurality of nano-elements may be passed through a second electromagnetic (EM) field, generated for example by a suitably variable charging electrode, for imparting a second preselected charge thereto. In this manner, 'waves' of groups of nano-elements may be passed through various different EM fields to impart respective preselected charges to the groups of nano-elements; thus, providing directional control allowing different charge-receptive areas of various charges (whether the charge(s) are given to the areas initially, or thereafter but prior to the dispersion of the particular wave/group of targeted nano-elements) to attract selected waves of nano-elements.

A conductive device assembled according to the invention can further comprise a second charge-receptive area located a distance, d, from the first charge-receptive area; as well as third and fourth such areas (collectively forming one or more patterns of areas to which nano-elements may be attracted and thereafter affixed, more-permanently, such as by application of an aerosol adhesive, one or more spot welds employing suitable solder, one or more spot application of thermal energy, and so on). The charge-receptive areas may comprise deposits of ions, localized conductive areas such as a via or pad-like structure to which a variable voltage potential may be applied, and other suitable means of applying a respective localized charge to the support surface/structure. All or a select few of the charge-receptive areas may be generally electrically-insulated from one another according to a final device structure. For example, each of the charge-receptive areas may comprise a protuberance electrically insulated from one another to retain a respective independently controllable charge. To provide further design flexibility, the second charge-receptive area may be charged to initially repel the first end-portion of the nano-element and to attract a first end-portion of a second nano-element.

In the event a second charge-receptive area is located a distance, $d_1$, from the first charge-receptive area, where $d_1$ is less than an average length, l, of the nano-element and a first end-portion is attached to the first area, attaching the other end-portion of the nano-element can be done such that a bridge shorting the two charge-receptive areas is formed. To discourage such nano-element bridge shorts, for example, between the first and a third charge-receptive area (separated a distance, $d_2$) and between a second and the third charge-receptive area (separated a distance, $d_3$), $d_2$ and $d_3$ can be made greater than length, l. Or in this case, more than one nano-element may be employed in chain-fashion to short the first and third areas.

Further distinguishing specific features of the apparatus and method include: dispersing a second plurality of conductive elongated nano-elements within the carrier-fluid such that the second plurality passes through a second electromagnetic field for imparting a second preselected charge thereto; a variable charging electrode for generating a selected initial EM field and controlled to generate subsequent electromagnetic fields through which later waves/groups of conductive elongated nano-elements may be passed for imparting associated respective preselected charges thereto; also a pair of deflection plates between which the nano-elements pass after passing through a respective electromagnetic field but prior to attachment to a respective charge-receptive area.

Additional, further distinguishing associated features of the apparatus for assembling a conductive device and method can be readily appreciated accordingly.

BRIEF DESCRIPTION OF THE DRAWINGS

For purposes of illustrating the flexibility of design and versatility of the innovative apparatus, method, and conductive devices produced thereby, the invention will be more particularly described by referencing the accompanying drawings of embodiments of the invention (in which like numerals designate like parts). The figures have been included to communicate the features of the invention by way of example, only, and are in no way intended to unduly limit the disclosure hereof.

DETAILED DESCRIPTION OF THE PREFERRED EMBODIMENTS

According to known convention: An ink jet printer is a printer that propels droplets of ink directly onto paper. Today, almost all ink jet printers produce color, and are continuous ink or drop-on-demand types: The first ink jet mechanism that was developed sprays a continuous stream of droplets that are aimed onto the paper. The deflection plates through which charged ink droplets pass, in effect 'guide' the charged ink droplets to each desired position on a fibrous-substrate (i.e., paper). Current ink jet technology allows for the printing of alphanumeric characters at a rate of many-thousands of characters per second for droplet nozzle diameters at or smaller than 1 $\mu$m. Most ink jet printers use the drop-on-demand method, which forces a drop of ink out of a chamber by heat or electricity. The thermal method used by the Hewlett-Packard Company, Canon Company and others heats a resistor that forces the a droplet of ink out of the nozzle by creating an air bubble in the ink chamber. Epson Company and others use a piezoelectric technique that charges crystals which expand and "jet" the ink. For reference, listed below are publications detailing various conventional ink jet printing technology and also ionographic printing techniques/equipment, each of which is incorporated herein by reference to the extent background in jet and ionographic technical information and details of alternative assemblies for use according to the invention, are set forth:

(A) U.S. Pat. No. 5,257,045 issued to Bergen et al. on Oct. 26, 1993 entitled "Ionographic Printing With a Focused Ion Stream";

(B) U.S. Pat. No. 4,463,363 issued to Gundlach et al. on Jul. 31, 1984 entitled "Fluid Assisted Ion Projection Printing";

(C) U.S. Pat. No. 4,524,371 issued to Sheridon et al. on Jun. 18, 1985 entitled "Modulation Structure for Fluid Jet Assisted Ion Projection Printing Apparatus"; and (D) W. L. Buehner, J. D. Hill, T. H. Williams, J. W. Woods, "Application of Ink Jet Technology to a Word Processing Output Printer", IBM J. RES. DEVELOP, pp. 2–9, (January 1977).

Figure 1:
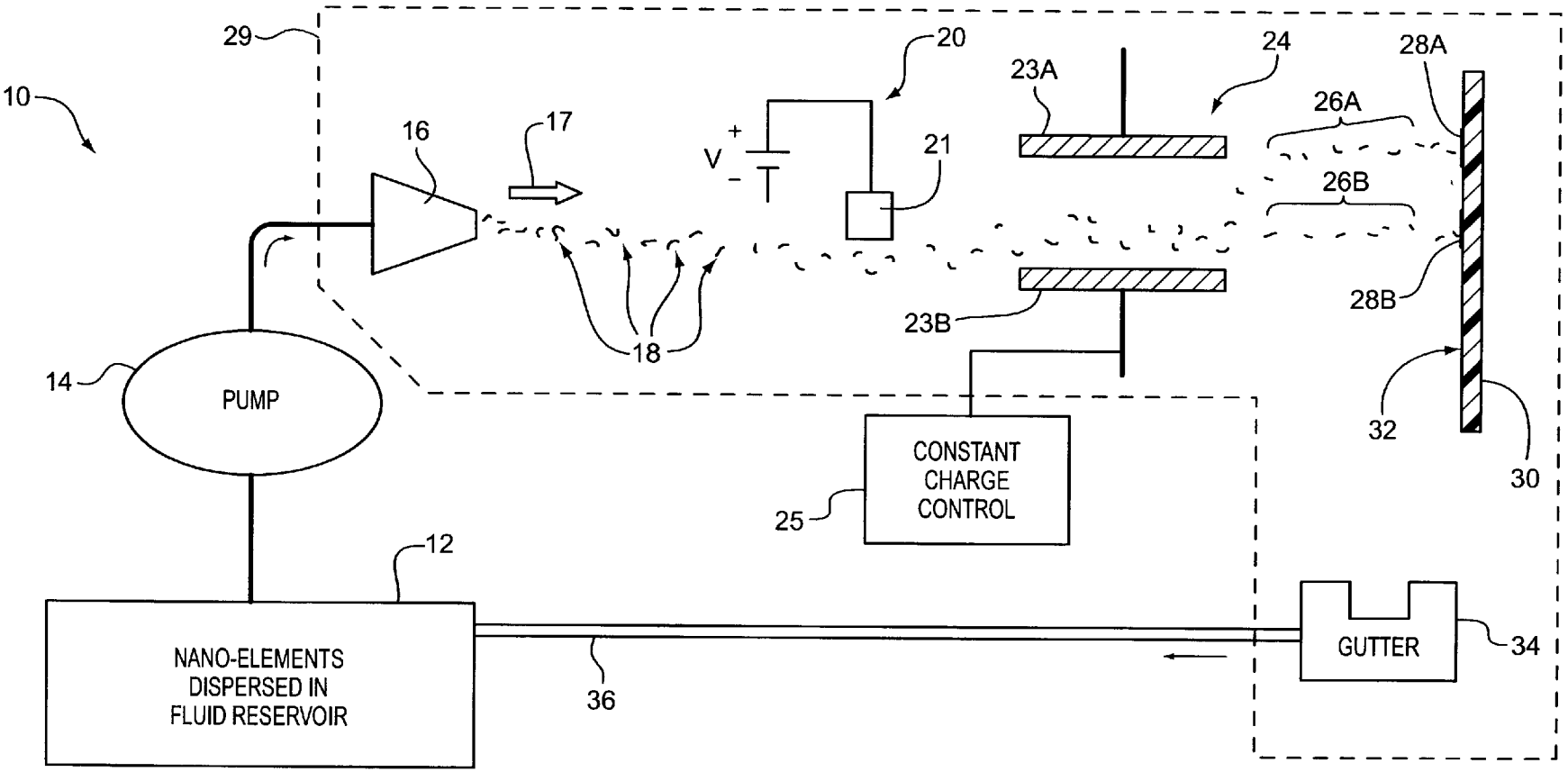
FIG. 1 schematically depicts components of an apparatus and method of the invention for assembling a conductive device having a first charge-receptive area of a support surface toward which at least one of a plurality of elongated nano-elements is directed and attaches.
Figure 2A:
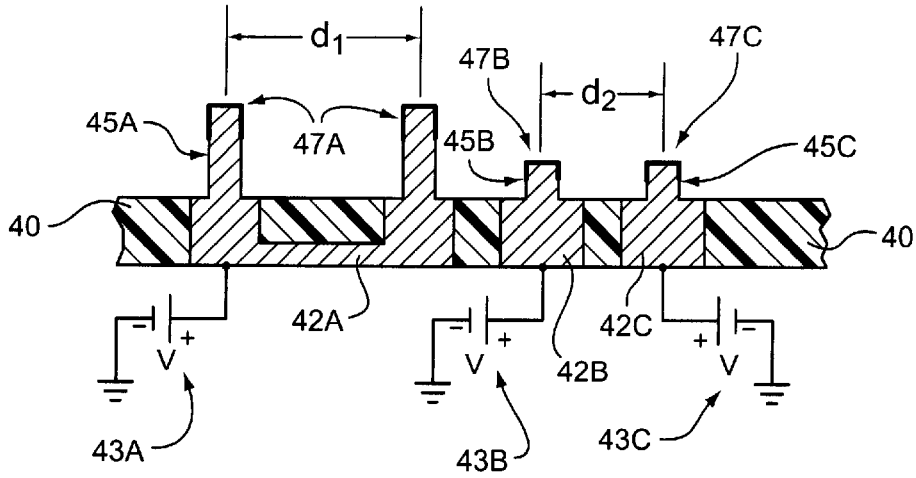
FIGS. 2A–2D are partial sectional drawings of suitable configurations of a substrate support (e.g., at 30, 40, 50, 60) having charge-receptive areas (e.g., labeled and shown at 31A–B, 47A–C, 57A–D, 67A–C).
Figure 2B:
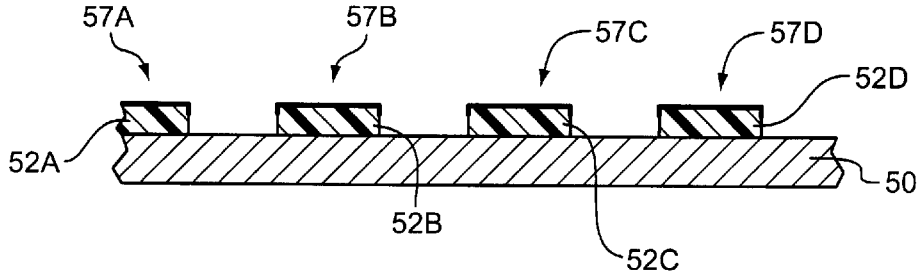
Figure 2C:
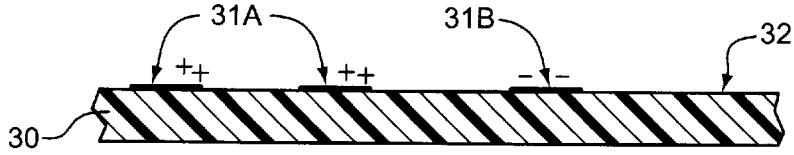
Figure 2D:
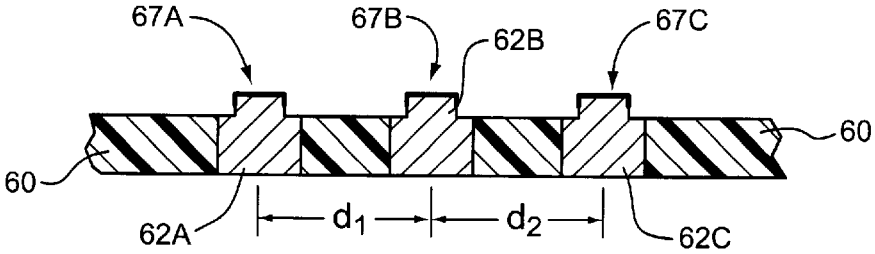

The apparatus 10 represented in FIG. 1 depicts in simple schematic various components and subassemblies of an apparatus of the invention. As mentioned above, for those who have attempted, there have been many problems encountered when manipulating one of the more heavily investigated nano-element shape, namely the carbon nanotube. Currently, these tiny elongated elements are manually positioned in place (as has been done to build the field effect transistor, FET, shown by Collins and Avouris, "Nanotubes for Electronics" Scientific American, December 2000, pg. 63). In FIG. 1, nano-elements (represented generally at 18) contained in a suitable reservoir 12 as a dispersion within a carrier-fluid, are directed out through nozzle 16 along direction arrow 17 and toward charge-receptive areas such as those represented at 28A, 28B of substrate surface 32 of substrate support 30 (shown, by way of example, as a dielectric). The dispersion of nano-elements within a carrier-fluid held in reservoir 12 is pumped or otherwise forced through nozzle 16, with a suitable pump or high pressure source assembly 14. For example, in the event the carrier-fluid is in a gas state, assembly 14 would provide sufficient pressure to force the dispersion through nozzle as a selected rate according to well known principles of fluid dynamics. If the carrier-fluid is in a liquid state several nano-elements may fit into a single micro-sized droplet of a dispersive liquid (represented at 13 in FIG. 3) such as isopropanol or deionized water ($H_2O$) forced out nozzle 16. In either case, the carrier-fluid is selected so as not to affect polarity of nano-element once a charge is imparted thereto by way of EM field generation assembly 20 having a variable charging electrode 21 connected to a controllable voltage source. Further, preferably the nano-elements are generally uniformly distributed within the carrier-fluid. For example, the reservoir (which may have one or more physical boundary amounting to several smaller connected dispersion wells) may be vibrated or otherwise periodically rotated to maintain such uniformity.

The particular charge imparted to each nano-element passing in direction 17 toward its target surface, is determined from characteristics of the various components of the system of the invention such as: aspect ratio (length/diameter) of the elongated nano-elements (nanotubes currently being produced according to techniques developed over the past several years have an aspect ratio on the order of 1 $\mu$m/100 nm to 100 $\mu$m/100 nm, or roughly $10^3$; the aspect ratio of nano-elements according to the invention to build conductive devices contemplated hereby, preferably ranges from 100 to 10,000); charge retained by the targeted charge-receptive areas 28A, 28B; the number and configuration of such areas 28A, 28B being targeted (for example, one or more patterns of charge-receptive areas); properties of the substrate 30 and its surface 32; the type/state of the dispersion fluid; final structure of the conductive device being assembled (for example, single or multiple layer of nano-elements), and so on.

Also shown in FIG. 1 is a pair of conductive plates (23A, 23B) across which a fixed high voltage can be formed (by way of control 25) to deflect nano-elements within a respective wave/group such as those represented at 26A, 26B (having already passed through the EM field produced by assembly 20), toward their target areas 28A, 28B. This is preferred where further control of nano-elements flow is necessary to hit targeted charge-receptive areas. A gutter, such as that at 34, may be employed (see also, box 220 in FIG. 5), along with a mechanism for removing unattached nano-elements from around areas 28A, 28B of surface 32 (such as low pressure clean-air jets), to collect stray nano-elements and feed them along 36 back to reservoir 12 for reincorporated with the dispersion held therein. This might be particularly useful where the particular raw material nano-elements used in apparatus 10 were costly to produce. In the event the carrier-fluid is a gas, as has been explained above, decreasing undesirable turbulence around the conductive device/structures as they are being built is preferred by way of, for example, placing certain of the assemblies of apparatus 10 under vacuum, such as those encased by boundary 29, from atmospheric pressure surrounding subsystem 29.

Note that, for elongated conductive nano-elements charge imparted thereto will collect at each end rather than being uniformly distributed over the surface as is the case for an ink drop leaving a nozzle of an ink jet printer. This is an effect noted long ago by Michael Faraday on the $15^{th}$ of January 1836 as recorded in his laboratory notebook number 2813 from "*The Philosopher's Tree, Michael Faraday's Life and Work In His Own Words*" (compiled by Peter Day and published by Institute of Physics), and further substantiated thereafter: Charge on a conductive element that is exposed to an EM field will generally collect in the regions where the radius of curvature is greatest for that element (which is, for an elongated-shaped element, generally at each of its ends).

FIGS. 2A–2D depict several of the very many suitable charge-receptive area patterns such as those labeled 47A–C, 57A–D, 31A–B, 67A–C atop, respectively, protuberances labeled 45A–C of conductive pads 42A–C, dielectric pads 52A–D, a generally planar support surface 32, and conductive pads 62A–C; as well as various corresponding substrate support configurations (labeled respectively, 40, 50, 30, 60). The type of charge-receptive area employed will depend upon the state of the carrier-fluid (liquid or gas). In the case of a gas dispersion, ion deposits may be preferable and can be deposited according to known ionographic printing techniques to charge a generally nonconductive surface (see, especially, FIGS. 2B and 2C). Alternatives, as explained above, include applying a voltage potential to each respective area as is shown by way of example in FIG. 2A employing voltage sources 43A–C, such that the charge is retained at respective areas 47A–C at least until the target nano-element so attaches. By way of reference only, the distance between areas 47A (both driven by source 43A) is labeled $d_1$ and that between 47B and 47C (driven respectively by sources and 43C) is $d_2$; likewise distances $d_1$ and $d_2$ between 67A, 67B, 67C are labeled in FIG. 2D for reference purposes.

Figure 3:
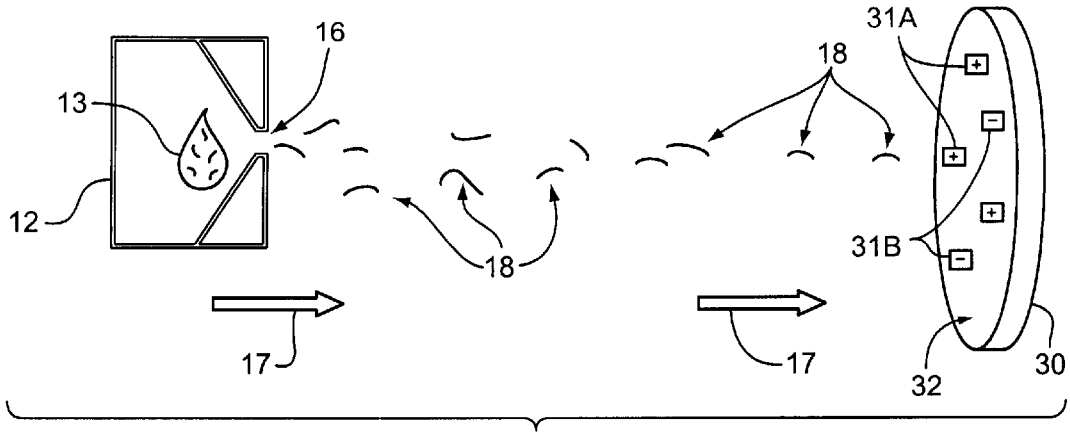
FIG. 3 depicts distinguishing features of the invention, in schematic form, including reservoir 12 with carrier fluid droplet 13 containing nano-elements 18 directed along 17 toward charge-receptive areas 31A–B.
Figure 4A:
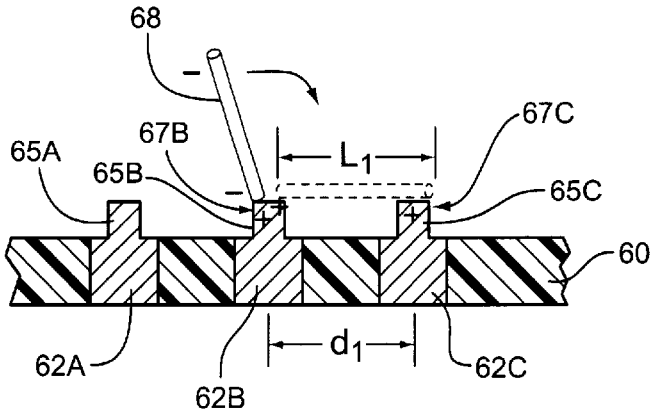
FIGS. 4A–4B are partial sectional drawings of a substrate support (60, 160) having charge-receptive areas (such as that labeled 67B–C) to which at least one end-portion of a nano-element (shown at 68, 128, 138) has attached.
Figure 4B:
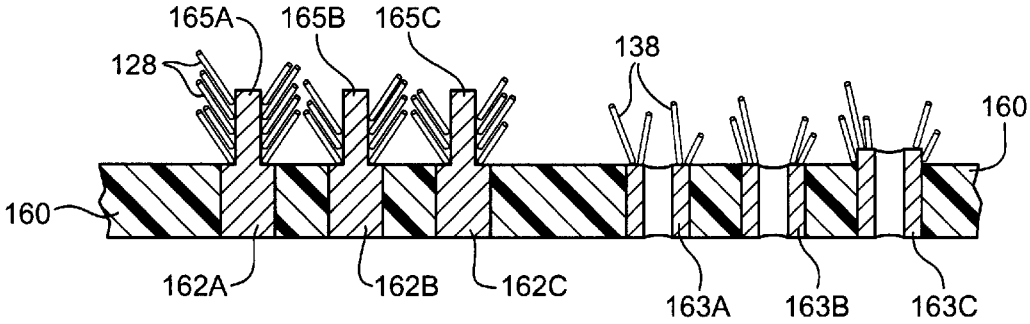
Figure 5:
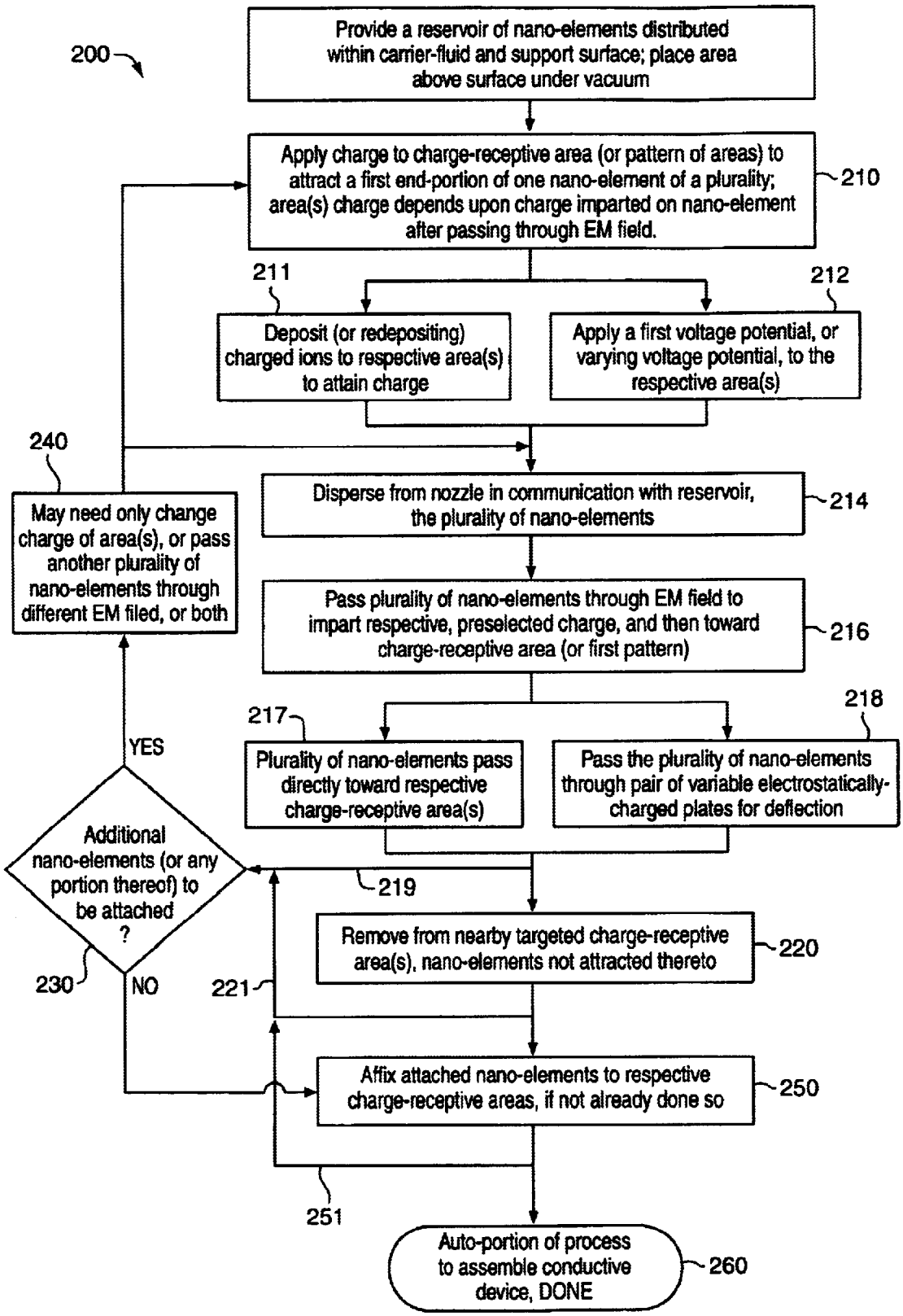
FIG. 5 is a flow diagram depicting features of a method 200 of the invention including detail of further distinguishing features thereof.

One can see the results of applying the method of the invention as contemplated herein (certain details of which are depicted in FIG. 5 in flow-diagram format), employing features identified above as depicted in the simple schematic labeled FIG. 3, to create novel conductive device structures such as those shown in FIGS. 4A and 4B. Suitable nozzles such as that depicted at 16 in FIG. 3 are available to provide desired element dispersions. Turning to FIGS. 4A and 4B, it is shown that one or more of the elongated nano-elements such as those at 68 having an average length identified in FIG. 4A as $L_1$ and those at 128, 138 in FIG. 4B, may be attached to respective protuberances 65A–C of pads 62A–C of FIG. 4A (charge-receptive areas at 67B–C) and pad/vias at 162A–C and 163A–C (associated latent charge-receptive areas, not specifically shown) of FIG. 4B. FIG. 5 illustrates the completion of this process at 260.

Thus, one can readily appreciate the design flexibility of the invention. For example, if the distance, d, between areas is less than l (or, as labeled in FIG. 4*a*, $L_1$) one or more nano-elements (thus creating several layers or a thickness) can be located to form a 'nano-element bridge' shorting the two neighboring charge-receptive areas (one end attaching to the first area and the other end to the second area). Alternatively if distance, d, is greater than l (or, as labeled in FIG. 4*a*, $L_1$) then to short the first and second charge-receptive areas it will require at least two nano-elements to create such a nano-element bridge (one end of one nano-element attaching to the first area and one end of a second nano-element attaching to the second area). Charge-receptive areas can be: on the surface of one or more projections/protuberances, a conductive pad atop of an insulative layer, insulator-pad atop a conductive layer, conductive via through substrate layer, aperture through an insulative layer open to a conductive lower surface, and so on, whereby specific outer shape of the area is not critical. Further, as mentioned above, more-permanent affixation of the nano-elements may be necessary to 'glue' the structure together for an extended useful lifetime of the conductive device assembled, where a temporary electrostatic-attraction of the nano-element(s) to respective charge-receptive areas is not sufficient (for reference, see box 250 in FIG. 5). Any suitable affixation means may be employed to do so, such as spray/aerosol adhesive, spot weld, spot melting/thermal energy, and so on.

Finally, FIG. 5 illustrates, in flow diagram format, details of the further distinguishing features of a method 200 of the invention. With the reservoir provided (such as that at 12 in FIG. 1) along with the target substrate surface (e.g., that depicted at 32 in FIGS. 2C and 3), application of charge to respective charge-receptive areas is performed 210 (can be by depositing ions to areas 211 or applying voltage potential to the areas 212). The dispersion of nano-elements in carrier-fluid is directed out of a suitable nozzle 214 and passes through the EM field to impart respective preselected charge to the elements 216. If further direction is desired, the nano-elements may be passed between deflection plates 218, or directed toward respective charge-receptive areas 217. If another/second end-portion of one or more nano-elements needs attaching, or additional waves/groups of nano-elements require passing through a different EM field to be charged with a different preselected charge (such that they will attach to additional charge-receptive areas within the same or another pattern of areas), following along direction arrows 219, 221, 251 additional nano-elements (230) may be built into the conductive device under construction. The flexibility of the process of the invention allows either the same charge-receptive areas be re-charged (or new areas charged), the nano-elements to be charged in another pass through the apparatus, or both, (box 240) such that additional nano-elements can be directed to new areas or nano-elements can be superimposed to create a mulit-layer structure of nano-elements. It is intended that in each reference to a charge or imparting a charge to an area or a nano-element, not only is electrical charge contemplated but also according to principles of magnetism, magnetic polarity of ferromagnetic areas and nano-elements can be set so as to attract the elements and build conductive devices of the invention.

While certain representative embodiments and details have been shown merely for the purpose of illustrating the invention, those skilled in the art will readily appreciate that various modifications may be made without departing from the novel teachings or scope of this invention. Accordingly, all such modifications are intended to be included within the scope of this invention as defined in the following claims. Although the commonly employed preamble phrase "comprising the steps of" may be used herein, or hereafter, in a method claim, the Applicants in no way intends to invoke Section 112 ¶6. Furthermore, in any claim that is filed herein or hereafter, any means-plus-function clauses used, or later found to be present, are intended to cover the structures described herein as performing the recited function and not only structural equivalents but also equivalent structures.

What is claimed is:

1. An apparatus for dispersing a first plurality of conductive elongated nano-elements distributed within a carrier-fluid to assemble a conductive device therewith, comprising:

a nozzle through which the elongated nano-elements are directed such that the nano-elements pass through an electromagnetic field for imparting a preselected charge thereto, and toward at least a first charge-receptive area of a support surface, said charge-receptive area having a charge to attract a first end-portion of one of the nano-elements; and the conductive device comprising said first charge-receptive area to which at least said one nano-element has attached.

2. The apparatus of claim 1 wherein the carrier-fluid is in liquid form and substantially evaporates once said one nano-element has attached; the plurality of elongated nano-elements being dispersed within at least one droplet of the carrier-fluid; and the conductive device further comprises a second charge-receptive area having a second charge to attract a first end-portion of a second of the plurality of nano-elements, said second charge-receptive area being located a distance, d, from said first charge-receptive area.

3. The apparatus of claim 1 wherein the carrier-fluid is a gas, an enclosed area around said nozzle and said first charge-receptive area is under vacuum; and the conductive device further comprises a second charge-receptive area located a distance, d, from said first charge-receptive area, said second charge-receptive area charged to initially repel said first end-portion of said one nano-element.

4. The apparatus of claim 3 further comprising dispersing a second plurality of conductive elongated nano-elements within the carrier-fluid through said nozzle such that the second plurality passes through a second electromagnetic field for imparting a second preselected charge thereto and toward the second charge-receptive area charged to attract a first end-portion of one of the second plurality of nano-elements; and wherein the conductive device further comprises said second charge-receptive area to which at least said one of said second plurality of nano-elements has attached.

5. The apparatus of claim 3 wherein said second charge-receptive area is located a distance, $d_1$, from said first charge-receptive area; said distance, $d_1$, is less than an average length, l, of said one nano-element; and once said one nano-element has so attached to said first charge-receptive area, said charge of said second charge-receptive area is made to attract a second end-portion of said one nano-element such that a bridge shorting the first and second charge-receptive areas is formed.

6. The apparatus of claim 1 wherein the carrier-fluid is a gas that exits said nozzle at a high pressure, the conductive device further comprises a second, third, and fourth charge-receptive area to which a respective second, third, and fourth of the nano-elements has attached, each said second, third, and fourth charge-receptive area to comprise a conductive protuberance electrically insulated from one another to retain a respective independently controllable charge.

7. The apparatus of claim 1 wherein the conductive device further comprises a second charge-receptive area having a second charge to attract a second end-portion of said one nano-element, said second charge-receptive area is located a distance, $d_1$, from said first charge-receptive area; said distance, $d_1$, is less than an average length, l, of said one nano-element; each said first and second charge-receptive area comprises a deposit of ions.

8. The apparatus of claim 7 wherein said first end-portion is attached to the first charge-receptive area and said second end-portion is attached to said second charge-receptive area, such that said one nano-element forms a first bridge shorting the first and second charge-receptive areas; each said first and second charge-receptive area is on a respective one of a first and second protuberance from said support surface; and the conductive device further comprises a third charge-receptive area having a charge to attract a first end-portion of a second of the plurality of nano-elements, wherein a distance, $d_2$, between said first and third charge-receptive areas is greater than length, e, and a distance, $d_3$, between said second and third charge-receptive areas is greater than length, l.

9. The apparatus of claim 1 wherein the conductive device further comprises a second charge-receptive area having a second charge to attract a first end-portion of a second of the plurality of nano-elements; said second charge-receptive area is located a distance, $d_1$, from said first charge-receptive area; said distance, $d_1$, is greater than an average length, l, of said one nano-element; and a second end-portion of each said one nano-element and said second nano-element is in contact with a third of the plurality of nano-elements.

10. The apparatus of claim 1 further comprising a variable charging electrode for generating said electromagnetic field and capable of generating a second electromagnetic field through which a second plurality of conductive elongated nano-elements may be passed for imparting a second preselected charge thereto; each of said nano-elements of the first and second plurality having an aspect ratio on the order of 100 to 10,000; and wherein the conductive device further comprises a first pattern of charge-receptive areas including said first charge-receptive area and a second pattern of charge-receptive areas.

11. The apparatus of claim 10 wherein each said area of the first pattern has a charge to attract a first end-portion of nano-elements of the first plurality and each said area of the second pattern has a charge to attract a first end-portion of nano-elements of said second plurality; and further comprising a pair of deflection plates between which the first and second plurality of nano-elements pass after passing through said respective first or second electromagnetic field and prior to attachment to a respective charge-receptive area.

12. A method of assembling a conductive device having a first charge-receptive area of a support surface to which one of a first plurality of elongated nano-elements has attached, comprising the steps of:

applying a first charge to the first charge-receptive area to attract a first end-portion of the one nano-element; and dispersing from a nozzle, the plurality of elongated nano-elements distributed within a carrier-fluid initially contained in a reservoir, such that the nano-elements pass through an electromagnetic field for imparting a preselected charge thereto and toward the first charge-receptive area.

13. The method of claim 12 wherein said carrier-fluid is in liquid form and substantially evaporates once said one nano-element has attached; said step of applying a first charge comprises applying a first voltage potential to said first area so that said charge is retained at least until said one nano-element so attaches; and further comprising the step of affixing said one nano-element to the first charge-receptive area.

14. The method of claim 13 further comprising the step of, once said first end-portion has attached to the first area, applying a charge to a second charge-receptive area to attract a second end-portion of the one nano-element; and wherein said step of dispersing further comprises passing a second plurality of the nano-elements through a second electromagnetic field for imparting a second preselected charge thereto; and said step of affixing comprises applying a aerosol adhesive.

15. The method of claim 12 wherein said carrier-fluid is a gas, and said step of applying a first charge comprises depositing charged ions to the first area prior to said step of dispersing.

16. The method of claim 15 wherein said step of dispersing further comprises passing a second plurality of the nano-elements through a second electromagnetic field for imparting a second preselected charge thereto, and said step of affixing comprises a spot application of thermal energy; and further comprising the step of removing from nearby the first charge-receptive area, those of the first plurality of nano-elements not so attached.

17. The method of claim 12 wherein said step of dispersing further comprises, once the nano-elements pass through said electromagnetic field, directing the nano-elements toward a second and third charge-receptive area, said second area charged to attract a second end-portion of a second nano-element of the first plurality and said third area charged to initially repel said second end-portion; and said step of applying a first charge comprises depositing charged ions to the first area.

18. The method of claim 12 wherein said step of dispersing further comprises, once the nano-elements pass through said electromagnetic field and prior to attachment to the first area, passing the nano-elements between a pair of deflection plates; and further comprising the step of applying a second charge to a second charge-receptive area of the support surface to attract a second end-portion of the one nano-element forming a short therewith between said first and second charge-receptive areas.

19. A method of assembling a conductive device having a first pattern of charge-receptive areas of a support surface to which a first and second of a first plurality of elongated nano-elements has attached, comprising the steps of:

applying a first charge to at least a first and second charge-receptive area of the first pattern to attract a respective first and second nano-element; and dispersing from a nozzle, the plurality of elongated nano-elements distributed within a carrier-fluid initially contained in a reservoir, such that the nano-elements pass through an electromagnetic field for imparting a preselected charge thereto and toward said first and second charge-receptive areas.

20. The method of claim 19 wherein said carrier-fluid is a gas and an area around said nozzle and said first and second charge-receptive area is under vacuum; said step of applying a first charge comprises depositing charged ions to the first and second areas; and further comprising the step of applying a second charge to a third area of the first pattern to attract a nano-element of a second plurality of elongated nano-elements having passed through a second electromagnetic field.

21. The method of claim 19 wherein said carrier-fluid is a liquid; said step of applying a first charge comprises applying a first voltage potential to said first and second areas so that said charge is retained at least until said respective first and second nano-elements so attach.

22. The method of claim 21 wherein said step applying further comprises applying a second charge to a second pattern of charge-receptive areas to attract nano-elements of a second plurality of nano-element; and said step of dispersing further comprises passing said second plurality through a second electromagnetic field for imparting a second preselected charge thereto.

* * * * *